United States Patent [19]

Klunsch et al.

[11] 3,996,078

[45] Dec. 7, 1976

[54] EXPLOSIVE COMPOSITION AND EUTECTIC MIXTURE THEREFOR

[75] Inventors: Maximilian Klunsch, Opladen; Paul Lingens, Leverkusen; Heinz Ratz, Bonn-Ippendorf, all of Germany

[73] Assignee: Dynamit Nobel Aktiengesellschaft, Troisdorf, Germany

[22] Filed: Apr. 24, 1975

[21] Appl. No.: 571,182

Related U.S. Application Data

[60] Division of Ser. No. 413,720, Nov. 7, 1973, Pat. No. 3,926,696, which is a continuation of Ser. No. 259,353, May 26, 1972, abandoned.

[30] Foreign Application Priority Data

May 29, 1971 Germany ..... 2126921
May 29, 1971 Germany ..... 2126922

[52] U.S. Cl. ..... 149/2; 149/41; 149/60; 149/88; 149/92; 149/105; 252/74

[51] Int. Cl.[2] ..... C06B 45/00; C09K 50/00

[58] Field of Search ..... 149/47, 78, 38, 41, 149/43, 44, 92, 2, 60, 105, 88; 252/74

[56] References Cited

UNITED STATES PATENTS

| | | | |
|---|---|---|---|
| 2,455,205 | 11/1948 | Whetstone | 149/47 |
| 2,548,693 | 4/1951 | Whetstone | 149/47 |
| 2,736,742 | 2/1956 | Enoksson | 149/38 |
| 2,817,581 | 12/1957 | Rinkenbach | 149/47 |
| 3,166,452 | 1/1965 | Gordon | 149/46 |
| 3,166,555 | 1/1965 | Gordon | 149/46 |
| 3,238,074 | 3/1966 | Griffith | 149/44 |
| 3,247,033 | 4/1966 | Gordon | 149/46 |
| 3,645,809 | 2/1972 | Stow | 149/38 |
| 3,676,234 | 7/1972 | Schwoyer | 143/43 |
| 3,684,596 | 8/1972 | Vercauteren | 149/44 |

*Primary Examiner*—Samuel W. Engle
*Assistant Examiner*—Donald P. Walsh
*Attorney, Agent, or Firm*—Burgess, Dinklage & Sprung

[57] ABSTRACT

A high energy explosive composition comprising an inorganic oxygen supplying salt, a metallic fuel and a eutectic mixture comprising an oxygen supplying salt and a combustible compound capable of lowering the solidification point of the oxygen supplying salt in admixture therewith in the eutectic composition; a eutectic composition comprising an oxygen supplying salt, a compound capable of reducing the solidification of said oxygen supplying salt and in admixtured therewith at least 30% by weight of a composition comprising an alkanolamine nitrate or perchlorate.

19 Claims, No Drawings

EXPLOSIVE COMPOSITION AND EUTECTIC MIXTURE THEREFOR

This is a division, of application Ser. No. 413,720, filed Nov. 7, 1973, now Pat. No. 3,926,696 which, in turn, is a continuation of Ser. No. 259,353 filed May 26, 1972, now abandoned.

BACKGROUND OF THE INVENTION FIELD OF THE INVENTION

This invention is directed to improve high energy explosive compositions particularly those comprising nitrates such as ammonium nitrate. More particularly, this invention is directed to high energy ammonium nitrate containing explosive compositions which have a reduced sensitivity to shock, an increased safety factor, characterized by an exceptionally high explosion heat. This invention is directed, also, to an improved eutectic mixture in which the oxygen supplying salt e.g. ammonium nitrate, is dissolved which eutectic mixture permits the explosive composition to remain liquid at a temperature below −10° C.

DISCUSSION OF THE PRIOR ART

Explosive slurries comprising ammonium nitrate, aluminum and water have been known. Under certain circumstances, they also contain water soluble fuels such as, for instance, glycol, formamide, methylamine, urea or sugar. The water is, however, always an important constituent of these explosive mixtures. The high handling safety of the explosive slurries is achieved principally because of the presence of this water component. When these explosives react during detonation, a substantial portion of the total energy which could produced is lost because of the presence of this added water. Hence, the available energy is considerably less than the total energy which could be calculated and expected from a given dynamite or explosive charge. One reason for this is that a portion of the total energy is used to evaporate the added water. For instance, a mixture of 75% of ammonium nitrate and 25% of aluminum exhibits an explosion heat of 1860 kcal/kg. On the other hand, a mixture of 55% of ammonium nitrate, 25% of aluminum and 20% by water has an explosion heat of only 1538 kcal/kg.

Additionally, ammonium nitrate explosives containing proportions of eutectic melt mixtures, which are liquid between −10° and +30° C are known. However, these explosive mixtures always contain brisant explosives especially water insoluble brisant explosives, such as glycerine, trinitrate, pentaerythritol tetranitrate or cyclotrimethylene trinitramine. It is necessary to add these explosive components in order to provide the mixtures with a detonation capacity at all sufficient for use in practice. However, as a result of the content in brisant explosives, these mixtures have a decided drawback, namely, they have a handling safety that is lower than that of the aforementioned explosive slurries. Moreover, that portion of the eutectic melt mixtures which solidifies above 10° C. can, in practice, not be employed for use in explosive mixtures since, in that case, an explosive has to maintain its consistency even at temperatures at less than 10° C.

From the above discussion, it is apparent that it has been long desired to provide a high energy explosive composition free of water insoluble brisant explosive components which explosive composition is in the liquid phase at temperatures below 10° C especially at temperatures below −10° C. Gas and energy producing eutectic mixtures based on ammonium nitrate or urea and compounds such as ammonium sulfamate, ammonium thiosulfate, ammonium formate, ammonium acetate, ammonium thiocyanate and ammonium hypophosphite, acetamides, propionamides and methylamines nitrate are known. The drawback of these known eutectic mixtures consist in that the majority solidify at temperatures above 0° C. and a few at temperatures between −10° and 0° C. All of the foregoing known eutectic mixtures are solids at −10° C (determined at atmospheric pressure). However, for practical applications it is important that the eutectic mixtures will be liquid below −10° C. The importance attributable to this factor is apparent. If the explosive composition is still liquid at temperatures −10° C it can be stored readily in unheated warehouses and used under cold conditions where there is no danger of the components of the mixture solidifying and presenting a safety hazard.

OBJECTS OF THE INVENTION

The present invention has a principal object to provide a high energy explosive composition wherein the gas or energy producing source is maintained within a eutectic mixture which has a solidification point below +10° C. This invention also has as one of its principal objects the provision of an improved eutectic mixture which is liquid at temperatures below −10° C, determined atmospheric pressure. In a particularly desirable embodiment this invention has as one of its objects the provision of a eutectic mixture for use in accommodating high energy explosive components which explosive components are free of brisant explosives especially water insoluble brisant explosives.

SUMMARY OF THE INVENTION

Broadly, this invention contemplates an explosive composition comprising an oxygen supplying salt, a metallic fuel and a eutectic mixture which eutectic mixture comprises an oxygen supplying salt and a combustible compound whereby the compounds of said eutectic mixture are capable of reducing vice-versa the respective solidification points of these compounds to below +10° C.

In a particularly desirable embodiment the oxygen supplying salt in admixture with the metallic fuel and the eutectic mixture is an inorganic oxygen supplying salt, especially ammonium nitrate. In a highly desirable embodiment of the present invention, the composition of the eutectic mixture is selected such that the overall composition has a solidification point below −10° C.

In a particularly desirable embodiment of the present invention there is a eutectic mixture which comprises an oxygen supplying salt, a combustible compound and at least 30% by weight of a nitrate or perchlorate of a substance comprising a major amount of an alkanolamine, said eutectic mixture having a solidification point of −10° c.

In accordance with the present invention there has been found a suitable eutectic mixture for an explosive composition which composition is water free and does not comprise a brisant explosive composition. The explosive composition comprises an oxygen supplying salt, especially ammonium nitrate, a metallic fuel, especially aluminum and a eutectic mixture, which eutectic mixture itself comprises an oxygen supplying salt and a combustible compound. The eutectic mixture is balanced with respect to its components so that it has a solidification point of below +10° C, preferably below −10° C. Such a eutectic mixture can be mixed with an oxygen supplying salt and a metallic fuel. Hence, the overall explosive composition remains in the liquid phase to a temperature below at least +10° C and preferably liquid to temperatures below −10° C.

As indicated above, a highly desirable feature of the present invention resides in the provision of a novel eutectic mixture which is solid at temperatures below −10° C. This new and improved eutectic mixture comprises at least 30% by weight of a nitrate or perchlorate of a substance comprising a major amount of an alkanolamine. In a simple embodiment of such a eutectic mixture the mixture comprises at least 30% by weight of a nitrate or perchlorate of an alkanolamine, an oxygen supplying salt and a combustible compound. Preferably the nitrate or perchlorate is present in an amount between 50 and 70% by weight. It should be understood, in accordance with the present invention, that the nitrate or perchlorate in admixture with the oxygen supplying salt and the combustible compound need not comprise entirely the nitrate or perchlorate of an alkanolamine. It has been found that a major amount of the alkanolamine can, itself, be replaced by an alkyl amine as more fully described below.

DESCRIPTION OF PREFERRED EMBODIMENTS

Now inorganic oxygen supplying salt explosives, e.g. of ammonium nitrate of high handling safety and energy and free from water-insoluble brisant explosives have been found comprising the inorganic salt, a metallic fuel, which explosive is characterized in that it contains in addition thereto an energy producing eutectic mixture, which is liquid below +10° C, based on the eutectic mixture comprising the oxygen supplying salts and combustible compounds. Surprisingly, it has been found that these explosives have very high energy and yet possess great handling safety. Other explosives of very high energy such as for instance explosive gelatine (93% of nitroglycerine, 7% of nitrocellulose) or mixtures of nitric acid, dinitrotoluene, and aluminum have considerably lower handling safety. Generally the eutectic mixture comprises between 10 and 40% by wt. oxygen supplying salt and between 60 and 90% by wt. combustible compound. The inorganic salt dissolved in the eutectic mixture is present in the explosive mixture in amount between 20 and 70% by wt. while the metallic fuel is present in amount between 01 and 40% by weight.

The relative proportions of inorganic salt, e.g. ammonium nitrate, metallic fuel and eutectic mixture are as follows:

| | Broadly | Preferred |
|---|---|---|
| Inorganic Salt (e.g. $NH_4NO_3$) | 20 to 70 | 40 to 60 |
| Metallic Fuel (Al or $M_g$) | 0.1 to 40 | 2 to 15 |
| Eutectic Mixture comprising oxygen yielding salt and combustible compound | 15 to 40 | 20 to 25 |

It will be realized that the ratios depend upon the specific chemicals chosen and their interaction upon one another. In certain instances it may be desirable to adjust one ratio in response to another as they are mutually dependent in the sense that the over-all composition is detonatable.

The high energy is realized in the ammonium nitrate explosives according to the invention by the combination of oxygen supplying salts, such as ammonium nitrate, metallic fuels, such as e.g. aluminum and energy producing eutectic mixtures. In order to warrant the consistency of the ammonium nitrate explosives according to the invention during practical use, the eutectic mixture has to be liquid below +10° C. It is, however, of advantage to select the composition of the eutectic mixture in such a way that it is still liquid below −10° C.

Another prerequisite to be met by the eutectic mixture is its sufficient stability in connection with the metallic fuels. Since the eutectic mixture has a relatively high density, the ammonium nitrate explosives according to the invention can have high densities too.

The ammonium nitrate explosives according to the invention have a high handling safety because they do not contain any water-insoluble brisant explosive components and because surprisingly, the energy producing eutectic mixtures have only low percussion sensitivity. In the falling-weight test according to the method of Koenen and Ide (EXPLOSIVSTOFFE 1961, No. 2) a percussion sensitivity of 1.5 kpm was found for a mixture, whereas the gelatins of liquid nitric acid esters and nitrocellulose, which are used in presently known explosives, have one of 0.2 kpm. The energy producing eutectic mixtures comprise, on the one hand, an oxygen supplying inorganic salt and, on the other hand, a combustible compound which is capable of lowering the solidification point of the oxygen supplying inorganic salt. Together they yield gas and heat during their reaction.

The combustible compounds which lower the solidification point of these salts include the nitrates and perchlorates of amines and derivatives of ammonia. Primary, secondary and tertiary alkyl and aryl amines are contemplated. Generally, the alkyl amine will have between 1 and 5 carbon atoms in the alkyl group. Aryl amines contemplate amines having a single aryl nucleus, a fused ring aryl nucleus and an aryl group joined to another aryl group at a single carbon atom e.g. a biphenylamine. Examples of such amines include methylamine, ethylamine, aniline, phenylenediamine. Also contemplated are cyclic amines such as hexamethylenetetramine. As indicated above, particularly desirable amines include the alkanolamines especially those containing 2 to 6 carbon atoms in the alkyl group of the alkanolamine. In this connection particularly desirable alkanolamines contemplated include ethanolamine, 2-aminobutanol, to name but a few. More representative amines as set forth in the ensuing disclosure. Other compounds of types of compounds useful as combustible compounds in accordance with this invention comprise amines such as ethylenediamine, hexamethylenediamine and tetraethylenepentamine, to name a few. Similarly derivatives of ammonia including hydrazine, urea and its substitution products are contemplated as well as urethanes, guanidines and quaternary ammonium compounds. Quaternary ammonium compounds contemplated include tetramethylammonium chloride, tetramethylammonium sulfate, tetraethylammonium chloride, tetramethylammonium nitrate, tetraethylammonium sulfate, dimethyldiphenylammonium nitrate, to name a few.

Other combustible compounds which are suitable for lowering the freezing point are the ammonium salts of aliphatic caboxycyclic and sulfonic acids, especially those of aliphatic acids having between 1 and 6 carbon atoms. Other combustible compounds include ammonium formate, ammonium acetate, ammonium sulfamate and the amides of these acids, such as formamide and acetamide, urea and its derivatives such as urethanes and ureides and carbamic acid.

Ammonium thiocyanate, ammonium hypophosphite, ammonium thiosulfate, anhydrous sodium acetate and mono and oligosaccharides and also suitable as combustible compounds which lower the freezing point.

Liquid compounds which are soluble in the eutectic mixtures can also be added to the same such as high boiling alcohols (glycerine, glycol, diglycol and the like).

In order to control the consistency of the eutectic mixture there can be combined swelling agents therewith. These swelling agents protect the finished ammonium nitrate explosives against both demixing and the pentration of water. As swelling agent there may be used e.g. oligo or polysaccharides. Other substances, for instance, guar flour, carob bean flour, agar-agar, starch, cellulose derivatives (e.g. its esters, ethers and glycolates), albuminous substances and gelatins, gum arabic, tragecanth and alginates can be used.

Thickening agents such as polyacrylamides, polyacrylic acids, polyvinyl alcohol and polyhydroxymethylene can also be utilized as swelling agents; inert, finely divided thickening agents such as bentonite, silicic acid and silicates can also be employed.

The swelling agents may also be cross-linked under certain circumstances. By adding antibacterial agents such as e.g. salicylic acid, the swelling agents may be made stable.

In order to improve the dissolution of the swelling agent, up to 5% by wt. of water based on the finished ammonium nitrate explosive may be added to the eutectic mixture.

Light metals such as aluminum and magnesium as well as their alloys, silicon, ferrosilicon, ferrophosphorus and the like can be used as metallic fuels. The detonation capacity of the ammonium nitrate explosive according to the invention can be varied depending on what grain type of the metallic fuels is selected. They may be added in the form of flakes (e.g. varnish aluminum) and/or fine-grained powder and/or granules e.g. foil material and/or granulated material and/or chips. It is of advantage to utilize the metallic fuels in passivated form if the ammonium nitrate explosives are to be stored over lengthy period of time.

Mainly ammonium nitrate is utilized as oxygen supplying compound. Up to one half of its portion can be replaced by alkali and/or alkaline earth nitrates and/or perchlorates as well as by ammonium perchlorate. The detonation capacity of the explosives according to the invention can be affected by the grain size distribution of the oxygen supplying components. The same can be present in the forms known such as e.g. in the form of prills, granules, fine or coarse crystals. The oxygen supplying substances may also contain additivies which prevent caking.

As additional combustible substances solid and liquid materials can be used in the explosives according to the invention, such as e.g. coal dust, vegetable flour, wood meal, waxes and fats, solid hydrocarbons e.g. paraffin, resins, asphalt as well as vegetable oils, mineral oils and other liquid hydrocarbons having low vapor pressure.

In order to improve the properties such as plasticity and workability small quantities of surface-active substances can be added to the explosives according to the invention, such as e.g. higher fatty acids and the salts thereof, fat amines and fat sulfonates.

The detonation capacity can be affected in known fashion by air inclusions in the explosive mixtures according to the invention. Such air inclusions can be incorporated for instance by porous granules on the basis of metallic fuels, sulfur, plastics, ammonium nitrate as well as by hollow microspheres, e.g. on the basis of plastics (e.g. of phenolformaldehyde resins) or glass. It is also possible to incorporate air bubbles by introducing air into the explosive by means of a nozzle. Furthermore, gas inclusions can be incorporated by having a chemical reaction occur in the explosive mixture. An example thereof is the reaction of an acid with an inorganic carbonate such as acetic acid and sodium carbonate.

The eutectic mixture can be produced by melting the individual components together or by neutralizing the mixture of the basic substances with the above described acids, dissolving the other components of the eutectic melt and evaporating the water. During the neutraliziation the acids or bases can be mixed with the other components if no undesirable side reactions occur.

The eutectic mixture can be added as such to the other explosive components ammonium nitrate, metallic fuels and, if desired, other additives or may be produced in the finished explosive mixture.

The thickening agents may be added to the liquid eutectic mixture or to the finished explosive mixture.

The explosives according to the invention can be produced in the apparatus provided for conventional explosives or that for explosive slurries.

Depending on the application, the composition and consistency of the explosives according to the invention can be varied in such a way that they are available in the form of cartridges or a pumpable or pourable mass.

The advantages of the explosives according to the invention consist in their high energy and the simultaneously given greater handling safety. Even if the content in metallic fuel is low, there is an energy gain as compared to aqueous explosive slurries having the same content in metallic fuel. Another advantage is the fact that these explosives have a slurry-like gelatinous — plastic or halfgelatinous consistency and at the same time give off very high energy.

DESCRIPTION OF PREFERRED NOVEL EUTECTIC MIXTURE COMPOSITION

Now an energy producing eutectic mixture has been found based on oxygen supplying salts and combustible compounds, which is characterized by a content of at least 30% by wt., preferably 50 to 70% by wt., of nitrates and/or perchlorates of alkanolamines and a solidification point of below −10° C.

Surprisingly it has been found that by adding alkanolamine nitrates or perchlorates the solidification point of eutectic mixtures, which consist predominantly of oxygen supplying salts and combustible compounds, is lowered considerably, thereby eliminating the most important drawbacks of the known energy producing eutectic mixtures. Mixtures containing these proportions of these alkanolamine salts are liquid down to at least −10° C, but in appropriate compositions they are liquid even at −20° C and lower temperatures.

Primary, secondary and tertiary alkanolamines can be utilized as alkanolamines the nitrates or perchlorates of which are used in accordance with the invention. For instance: ethanolamine, 2-aminobutanol, 2-aminoisobutanol, diethanolamine, triethanolamine. The alkyl group can be straight chain or branched chained and can have up to 6 carbon atoms. Primary, secondary and tertiary alcohols are contemplated.

In accordance with an embodiment of the present invention, one can replace up to 50% by wt. of the alkanolamine salt by an alkylamine nitrate or perchlorate without raising the solidification point to above −10° C. The alkyl radicals of these alkylamine salts can be the same as those of the corresponding alkanolamines, but they may also be different therefrom. Generally the alkyl group can have up to 6 carbon atoms therein. The alkylamine can be a primary, secondary or tertiary amine.

In order to control the consistency the eutectic mixtures according to the invention may be combined with swelling in quantities of 0.1 to 10% by wt, preferably 1 to 5% by wt. The swelling agents protect these mixtures or ammonium nitrate explosives made therefrom against both demixing and the penetration of water. As swelling agents there may be used the above recited materials.

In order to more fully illustrate the nature of the invention in the manner of practicing the same, the following Examples are presented. Examples 1 through 5 illustrate the novel explosive composition of the present invention comprising the oxygen supplying salts, the metallic fuel and a eutectic mixture. The composition of the invention, as illustrated in the Examples, is free of a brisant explosive and desirably contains no water.

EXAMPLE 1

The ammonium nitrate explosive with the eutectic melt mixture, which has nearly completely solidified at −10° C, and a brisant explosive component (mixture 1a) as described in Example 4B of the U.S. Pat. No. 2,548,693 is compared with an ammonium nitrate explosive according to the invention consisting of aluminum, ammonium nitrate and a eutectic mixture which is still liquid at −30° C, (mixture 1b).

| Mixture | 1a | 1b |
|---|---|---|
| ammonium nitrate | 36.3% | 52.5% |
| sodium nitrate | 19.0% | 3.0% |
| gelated eutectic mixture | 3.5% | 22.5% |
| aluminum | — | 22.0% |
| glycerine trinitrate | 30.6% | — |
| liquid nitro bodies | 1.8% | — |
| collodion cotton (wet with alcohol) | 0.9% | — |
| Wood meal | 3.6% | — |
| cat husk meal | 4.0% | — |
| chalk | 0.3% | — |

| Eutectic Mixture 1a | Parts | Eutectic Mixture 1b | Parts |
|---|---|---|---|
| ammonium nitrate | 50.0 | methylamine perchlorate | 16.0 |
| urea | 25.0 | ethanolamine nitrate | 45.0 |
| sodium acetate tri-hydrate | 15.0 | methylamine nitrate | 16.0 |
| | | urea | 12.0 |
| sodium thiosulfate pentahydrate | 10.0 | ammonium nitrate | 11.0 |
| starch | 3.0 | guar flour | 2.5 |

The mixture 1*a* was prepared in the manner described in the U.S. patent. Mixture 1*b* was prepared accordingly.

The lead block bulge according to Trauzl for mixture 1*a* was: 340 to 360 $cm^3$/ 10 g, and for mixture 1b: 500 to 550 $cm^3$/10g. The percussion sensitivity for mixture 1*a* was: 0.4 kpm, and for mixture 1*b*: 2.1 kpm. This result evidences the high energy and handling safety of the explosive according to the invention compared to the explosive known from the U.S. patent.

EXAMPLE 2

Mixture 2*a* corresponds to mixture 1*b* of Example 1, but contains only 15% of aluminum in lieu of 22%. Mixture 2*a* is compared to a known aqueous slurry-like ammonium nitrate explosive which contains the same amount of aluminum, but has in addition thereto 20% of trinitrotoluene. (mixture 2*b*).

| Mixture | 2a | 2b |
|---|---|---|
| ammonium nitrate | 59.5% | 50.6% |
| aluminum | 15.0% | 15.0% |
| sodium nitrate | 3.0% | — |
| gelated eutectic mixture (as in mixture 1b) | 22.5% | — |
| trinitrotoluene | — | 20.0% |
| guar flour | — | 0.4% |
| water | — | 14.0% |

The lead block buldge according to trauzl for mixture 2*a* was: 480 to 490 $cm^3$/10 G, and for mixture 2*b*, in spite of the high content in TNT and the same content in aluminum, only: 350 to 360 $cm^3$/10g. The percussion sensitivity of the two mixtures is low; it corresponds approximately to that of mixture 1*b*.

EXAMPLE 3

An ammonium nitrate explosive according to the invention having 10% by wt. of aluminum and the following composition

| | |
|---|---|
| ammonium nitrate | 62.5% |
| sodium nitrate | 5.0% |
| aluminum | 10.0% |
| gelated eutectic mixture (as in mixture 1b) | 22.5% |

has a lead block bulge according to Trauzel of 460 to 480 $cm^3$/10 g. The percussion sensitivity corresponds to that of mixture 1*b*.

EXAMPLE 4

Three explosive mixtures 4*a* to 4*c* were prepared, all of which have 30% by wt. of eutectic mixture. The composition of the eutectic mixture differs however.

| | |
|---|---|
| gelated eutectic mixture | 30.0% |
| aluminum | 25.0% |
| ammonium nitrate | 45.0% |

The eutectic mixtures have the following compositions:

| Mixture | 4a | 4b | 4c |
|---|---|---|---|
| methylamine nitrate | 50% | 20% | 20% |
| ethanolamine nitrate | — | — | 50% |
| triethanolamine nitrate | — | 40% | — |
| urea | 30% | 20% | 15% |

-continued

| Mixture | 4a | 4b | 4c |
|---|---|---|---|
| ammonium nitrate | 20% | 20% | 15% |

The bulges according to Trauzl are as follows: mixture 4*a:* 470 to 480 $cm^3/10$ g: mixture 4*b:* 410 to 430 $cm^3/10$ g: mixture 4*c:* 500 to 525 $cm^3/10$ g. These explosive mixtures are very rich in energy. Their handling safety corresponds at least to that of mixture 1*b*.

EXAMPLE 5

This example describes an explosive mixture which, in addition to the eutectic mixture in accordance with example 4*c* and aluminum as metallic fuel, also contains other combustible substances such as glycol and coal dust, a surface-active flour and Styropor$^R$ (=foamed polystyrene) to introduce air bubbles.

| | |
|---|---|
| Gelated eutectic mixture (from mixture 4c) | 29.0% |
| glycol | 1.0% |
| guar flour | 0.2% |
| calcium stearate | 0.1% |
| coal dust | 1.0% |
| aluminum | 25.0% |
| Styropor | 0.3% |
| ammonium nitrate | 43.4% |

The bulge according to Trauzl is approximately 500 $cm^3/10$ g for this mixture. As a result of the air inclusions the density of this explosive is slightly lower than that of the preceding explosives. However, it also exhibits very high energy and high handling safety. The advantages of the novel eutectic mixture of the present invention utilizing a major amount of alkanolamines and explosives made from such novel eutectic mixture consists in that they can be used at temperatures below −10° C. Other advantages include the fact that the energy, detonation capacity and consistency of the eutectic mixture and explosives made therefrom can be varied within wide limits. The handling safety of these eutectic mixtures and explosives made therefrom depends upon the proportion of the detonatable components. It is, however, always considered better than that of the detonatable component alone. In order to illustrate the novel eutectic composition of the present invention, the following four examples are set forth:

EXAMPLE 6

The composition of the following six eutectic mixtures is in accordance with the invention. They were produced by melting together the individual components, and have the following composition listed by weight in the following table. All of them are still liquid at −20° C; individual ones are still liquid even at −35° C.

| | | | | | | |
|---|---|---|---|---|---|---|
| triethanolamine nitrate | 70 | — | — | — | — | — |
| ethanolamine nitrate | — | 63 | 32 | 51 | 56 | 63 |
| methylamine nitrate | 10 | — | 16 | 17 | 20 | 10 |
| urea | 10 | 27 | 32 | 17 | 24 | 27 |
| ammonium nitrate | 10 | 10 | 20 | 15 | — | — |

EXAMPLE 7

The following eutectic mixture, which is still liquid at −20° C, contains sufficient detonatable substances to yield a lead block bulge according to Trauzl of 250 $cm^3/10$ g.

| | |
|---|---|
| methylamine perchlorate | 20% |
| ethanolamine nitrate | 40% |
| methylamine nitrate | 13.5% |
| urea | 13.5% |
| ammonium nitrate | 12.0% |

If 100 parts of this eutectic mixture are combined with 0.5 parts of guar flour and 25 parts of aluminum, a lead block bulge according to Trauzl of more than 400 $cm^3/10$ g. is obtained.

EXAMPLE 8

The eutectic mixture according to the invention, which does not yet solidify at −20° C, consisting of

| Eutectic Mixture | Parts |
|---|---|
| methylamine perchlorate | 16.0 |
| ethanolamine nitrate | 45.0 |
| methylamine nitrate | 16.0 |
| urea | 12.0 |
| ammonium nitrate | 11.0 |
| guar flour | 2.5 |

was used to produce a plastic explosive having the following composition:

30% of gelated eutectic mixture

70% of cyclotrimethylenetrinitramine

The lead block bulge according to Trauzl was 380 $cm^3/10$ g.

EXAMPLE 9

An ammonium nitrate explosive of the following composition

| | |
|---|---|
| ammonium nitrate | 49.5% |
| sodium nitrate | 3.0% |
| aluminum | 10.0% |
| hexogen | 15.0% |
| gelated, eutectic mixture (as in example 3) | 22.5% |

yields a bulge according to Trauzl of 480 to 500 $cm^3/10$ g.

From the above, it can be readily seen that high energy explosive compositions which are liquid at temperatures below +10° C. have been provided. These compositions are characterized by the absence of water and brisant explosive compositions. They are produced from relatively inexpensive and readily available materials.

It is also seen from the above that a highly useful eutectic composition comprising a nitrate or perchlorate of an alkanolamine is provided. This eutectic mixture can be utilized alone, as the eutectic mixture which serves as a solvent for the oxygen supplying salt and metallic fuel discussed above, with brisant explosive compositions either of the water soluble or water insoluble type, or in a wide variety of compositions. It is particularly desirable to use the same as a solvent for other explosive compositions wherein the entire composition is maintained liquid at temperatures at below −10° C. From the data depicted above, it is apparent that the compositions of the present invention are improved with respect to safety features without sacrificing the energy upon detonation. These compositions are provided using readily available materials so selected that appreciable benefits are derived.

What is claimed is:

1. A flowable eutectic composition for use in an explosive which consists essentially of an oxygen supplying salt, a combustible compound and at least 30% by weight of a nitrate or perchlorate of an alkanolamine, said eutectic composition having a solidification point of below −10° C., said composition free of uncombined water.

2. A composition according to claim 1 wherein the alkyl group of the alkanolamine nitrate or perchlorate is a branched chain or straight chain and contains up to 6 carbon atoms in the chain.

3. A composition according to claim 2 wherein said alkanolamine is derived from either a primary alcohol, a secondary alcohol or a tertiary alcohol.

4. A eutectic composition according to claim 3 wherein said alkanolamine is selected from the group consisting of ethanolamine, 2-amino normal butanol, 2-amino isobutanol, diethanolamine and triethanolamine.

5. A composition according to claim 1 wherein the combustible compound comprises an alkylamine which is a primary amine, a secondary amine or a tertiary amine.

6. A composition according to claim 4 wherein the combustible compound is present in the eutectic composition in an amount between 60 and 90% by wt.

7. A composition according to claim 6 wherein said combustible compound is present in said eutectic composition in an amount between 70 and 80% by wt. based upon the weight of the eutectic composition.

8. A composition according to claim 6 wherein the oxygen supplying salt selected from the group consisting of ammonium nitrate and urea.

9. A composition according to claim 7 wherein ammonia nitrate and urea are present as the oxygen supplying salts in a weight ratio of 1 part by wt. ammonium nitrate to between 0.6 and 1.5 parts by weight urea.

10. A composition according to claim 1 wherein up to 50% by weight of said nitrate or perchlorate of alkanolamine is replaced by a nitrate or perchlorate of an alkylamine.

11. A composition according to claim 10 wherein the alkyl group of said alkylamine has up to 6 carbon atoms in the chain.

12. A flowable eutectic composition according to claim 1 wherein said combustible compound is selected from the group consisting of a nitrate or perchlorate of a primary, secondary or tertiary alkyl or aryl amine, hydrazine, urea, a urethane, a guanidine, a quaternary ammonium compound, an ammonium salt of an aliphatic carboxycyclic or sulfonic acid, an ammonium salt of an aliphatic acid having 1 to 6 carbon atoms, a ureide, carbamic acid.

13. A flowable eutectic composition according to claim 1 wherein said combustible compound is selected from the group consisting of an alkyl amine having between 1 and 5 carbon atoms in the alkyl group, an aryl amine having a single aryl nucleus, an aryl amine having a fused aryl nucleus, an aryl amine having an aryl group joined to another aryl group at a single carbon atom, an alkanolamine having 2 to 6 carbon atoms in the alkyl group of the alkanolamine, a quaternary ammonium compound, an ammonium salt of an aliphatic carboxycyclic acid, an ammonium salt of an aliphatic sulfonic acid, an ammonium salt of an aliphatic acid having between 1 and 6 carbon atoms.

14. A flowable eutectic composition according to claim 1 wherein said combustible compound is selected from the group consisting of methylamine, ethylamine, aniline, phenylene diamine, biphenyl, hexamethylene tetramine, ethanolamine, 2-aminobutanol, ethylene diamine, hexamethylene diamine, tetraethylene pentamine, hydrazine, urea, a urethane, a guanidine, tetramethylammonium chloride, tetramethylammonium sulfate, tetraethylammonium chloride, tetramethylammonium nitrate, tetraethylammonium sulfate, dimethyldiphenylammonium nitrate, ammonium formate, ammonium acetate, ammonium sulfonate, an amide of an aliphatic carboxycyclic acid, an amide of a sulfonic acid, an amide of an aliphatic acid having 1 to 6 carbon atoms, ammonium thiocyanate, ammonium hypophosphite, ammonium thiosulfate, anhydrous sodium acetate.

15. A flowable eutectic composition according to claim 1 wherein said combustible compound is formamide or acetamide.

16. A flowable eutectic composition according to claim 14 wherein said oxygen supplying salt is selected from the group consisting of ammonium nitrate, an alkali metal nitrate, an alkaline earth metal nitrate, an alkali metal chlorate, an alkaline earth metal chlorate and ammonium chlorate.

17. A flowable eutectic composition according to claim 14 wherein said oxygen supplying salt is ammonium nitrate and there is present in said composition an amount up to the weight of said ammonium nitrate of another oxygen supplying salt, said other oxygen supplying salt being an alkali or alkaline earth metal nitrate or alkali or alkaline earth metal chlorate or ammonium chlorate.

18. A flowable eutectic composition according to claim 1 wherein said oxygen supplying salt is present in said composition in an amount of 10–40% by weight, based upon the combined amounts of oxygen supplying salt and combustible compound, and said combustible compound is present in an amount of 60–90% by weight based upon the combined weight of said oxygen supplying salt and said combustible compound.

19. A flowable eutectic composition according to claim 16 wherein said oxygen supplying salt is present in said composition in an amount of 10–40% by weight, based upon the combined amounts of oxygen supplying salt and combustible compound, and said combustible compound is present in an amount of 60–90% by weight based upon the combined weight of said oxygen supplying salt and said combustible compound.

* * * * *